US010352109B2

(12) United States Patent
Sanchez

(10) Patent No.: US 10,352,109 B2
(45) Date of Patent: Jul. 16, 2019

(54) SYSTEM AND METHODOLOGY FOR COUPLING TUBING

(71) Applicant: Schlumberger Technology Corporation, Sugar Land, TX (US)

(72) Inventor: Mariano Ruben Sanchez, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 206 days.

(21) Appl. No.: 15/160,172

(22) Filed: May 20, 2016

(65) Prior Publication Data

US 2016/0340992 A1 Nov. 24, 2016

Related U.S. Application Data

(60) Provisional application No. 62/164,428, filed on May 20, 2015.

(51) Int. Cl.
*E21B 17/04* (2006.01)

(52) U.S. Cl.
CPC ..... *E21B 17/04* (2013.01)

(58) Field of Classification Search
CPC combination set(s) only.
See application file for complete search history.

(56) References Cited

U.S. PATENT DOCUMENTS 2,040,092 A * 5/1936 Leedy ..... F16L 13/08 285/289.1
4,492,115 A * 1/1985 Kahil ..... G01N 27/82 324/226
5,507,528 A * 4/1996 Mastrosimone ..... B23K 31/02 228/258
2004/0149418 A1* 8/2004 Bosma ..... E21B 29/10 164/98
2015/0101813 A1* 4/2015 Zhao ..... E21B 33/04 166/302

FOREIGN PATENT DOCUMENTS

WO WO-0166990 A1 * 9/2001 ..... E21B 33/14

* cited by examiner

*Primary Examiner* — D. Andrews
*Assistant Examiner* — Ronald R Runyan

(57) ABSTRACT

A technique facilitates coupling of sections of tubing, e.g. a casing and a liner. A first tubing is positioned at a desired location, and then a second tubing is deployed through an interior of the first tubing until predetermined regions of the first tubing and the second tubing are in proximity to one another. A molten metal material is located between the first tubing and the second tubing at the predetermined regions. The molten metal material is then solidified to secure the second tubing to the first tubing.

19 Claims, 5 Drawing Sheets

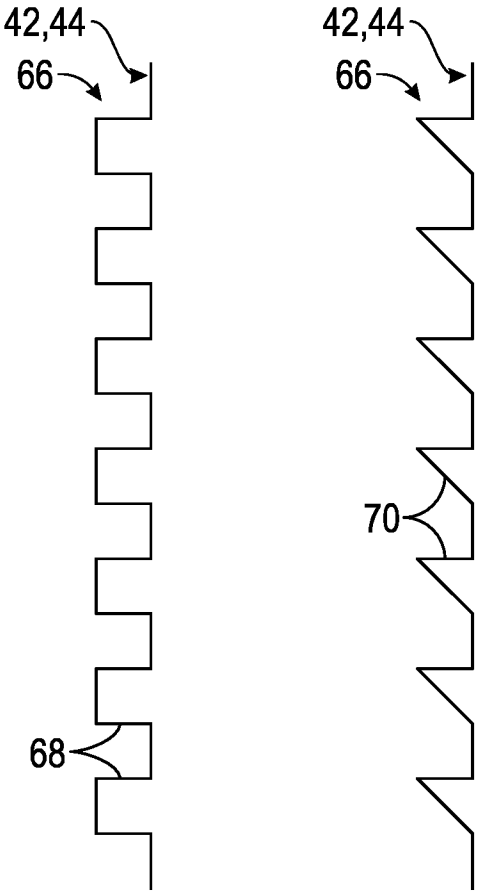
FIG. 3
FIG. 4
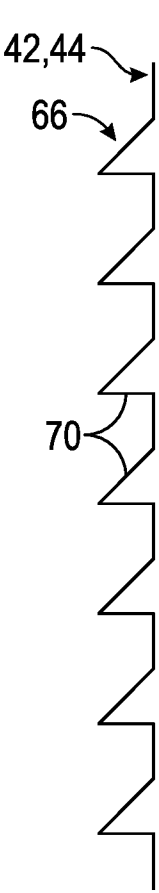
FIG. 5
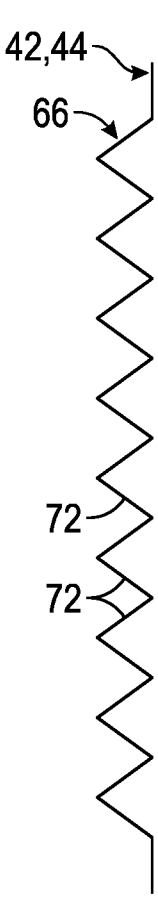
FIG. 6
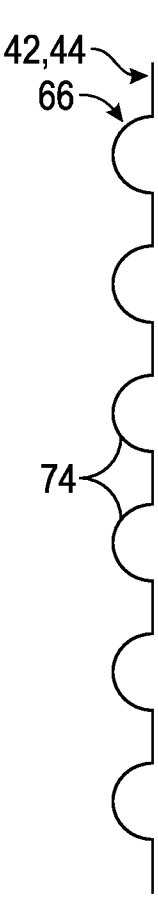
FIG. 7

SYSTEM AND METHODOLOGY FOR COUPLING TUBING

CROSS-REFERENCE TO RELATED APPLICATION

The present document is based on and claims priority to U.S. Provisional Application Ser. No.: 62/164,428, filed May 20, 2015, which is incorporated herein by reference in its entirety.

BACKGROUND

Oil and gas wells may be completed by forming a borehole in the earth and subsequently lining the borehole with a steel casing. In many applications, one or more sections of casing and one or more liners are used to complete the well. In a simplified example, after the well has been drilled to a first depth a first section of casing is lowered into the wellbore and hung from the surface. Cement is then injected into the annulus between the outer surface of the casing and the borehole. After drilling the well to a second designated depth, a liner is run into the well. The liner may then be fixed to the casing by using a liner hanger. The liner is then cemented in place.

SUMMARY

In general, a system and methodology facilitate coupling of sections of tubing, e.g. a casing and a liner. A first tubing is positioned at a desired location, and then a second tubing is deployed through an interior of the first tubing until predetermined regions of the first tubing and the second tubing are in proximity to one another. A molten metal material is located between the first tubing and the second tubing at the predetermined regions. The molten metal material is then solidified to secure the second tubing to the first tubing.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and:

FIG. 3 is an illustration of an example of a textured surface profile which can be used to facilitate joining of the second tubing to the first tubing, according to an embodiment of the disclosure;

FIG. 4 is an illustration of another example of a textured surface profile which can be used to facilitate joining of the second tubing to the first tubing, according to an embodiment of the disclosure;

FIG. 5 is an illustration of another example of a textured surface profile which can be used to facilitate joining of the second tubing to the first tubing, according to an embodiment of the disclosure;

FIG. 6 is an illustration of another example of a textured surface profile which can be used to facilitate joining of the second tubing to the first tubing, according to an embodiment of the disclosure;

FIG. 7 is an illustration of another example of a textured surface profile which can be used to facilitate joining of the second tubing to the first tubing, according to an embodiment of the disclosure;

DETAILED DESCRIPTION

Figure 1:
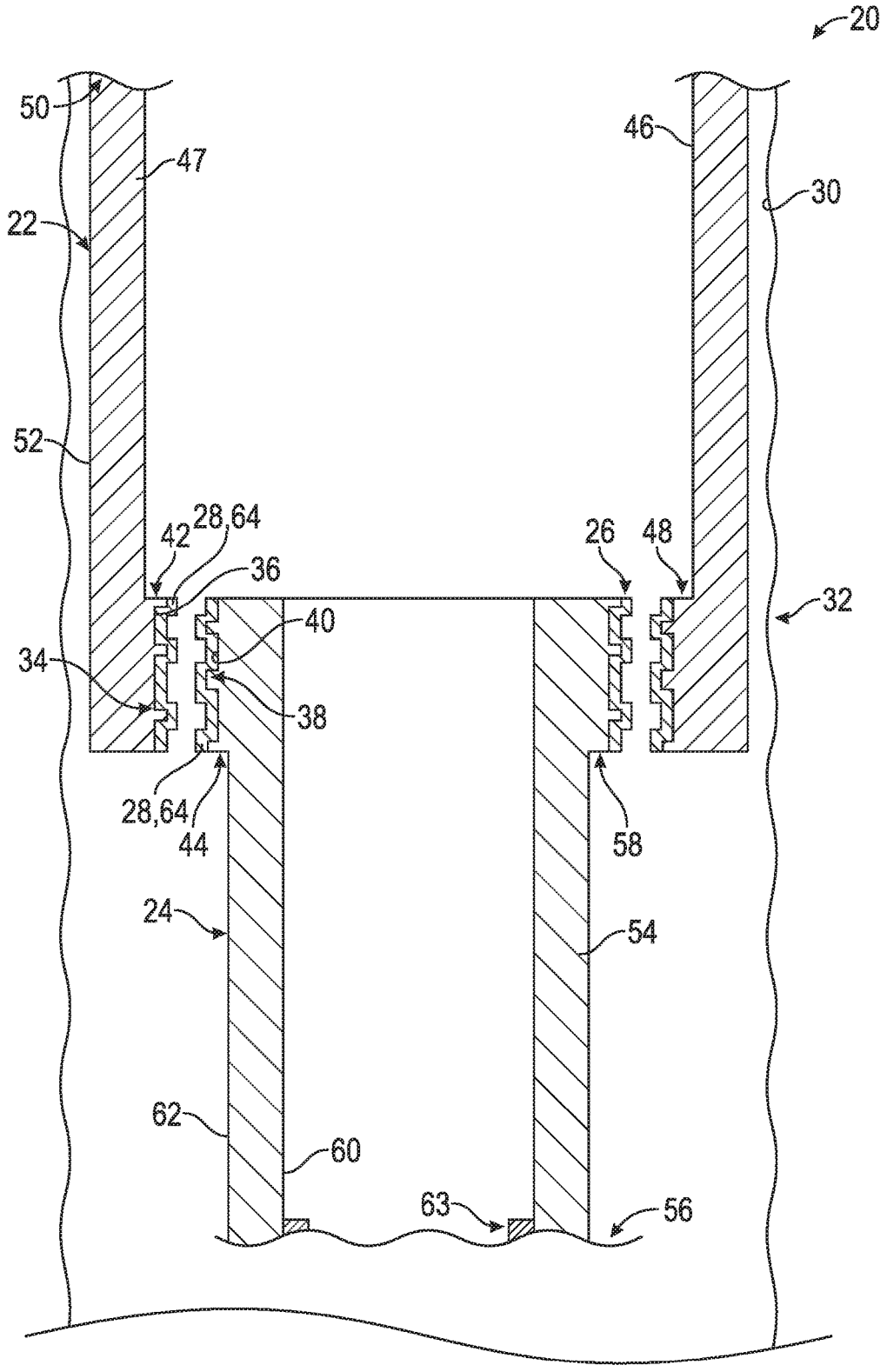
FIG. 1 is a schematic illustration of an example of a tubing hanger system for hanging a second tubing from a first tubing, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The present disclosure generally relates to a system and methodology which facilitate coupling of sections of tubing. In a well application, for example, the system and methodology may be used to facilitate coupling of sections of casing, e.g. coupling and suspending a liner from a section of casing. A first tubing is positioned at a desired location, e.g. a desired location in a borehole. Then, a second tubing is deployed through an interior of the first tubing until predetermined regions of the first tubing and the second tubing are in proximity to one another. A molten metal material is located between the first tubing and the second tubing at the predetermined regions. The molten metal material is then solidified to secure the second tubing to the first tubing.

In various well applications, the technique may be used for tubular hanging systems in which a supportive, metal-to-metal seal is formed between tubular elements. With this type of embodiment, a first tubular element may have an annular body portion and a receptacle with a textured surface. For example, the textured surface may be disposed on an interior surface of the first tubular element. Additionally, a second tubular element may have a textured surface disposed at an engagement region along an exterior surface of the second tubular element. Metal material may be disposed between the two textured surfaces, and the metal material may be deployed in molten form or converted to molten form. The molten metal material is then solidified between the opposing textured surfaces of the tubular elements to provide a supporting connection between the tubular elements. In certain well applications, the solidified metal coupling may be used to hang a liner from casing in a wellbore.

Some well related embodiments involve drilling a well to a first depth and lowering a first section of casing into the wellbore until the casing is hung from the surface. The casing may have an internal casing receptacle at its lower end. Additionally, the interior surface of the casing receptacle may be provided with a texture, e.g. a knurled texture, a waveform texture, or another suitable texture. It should be noted the waveform texture may be in the form of a variety of waveforms, such as square waveforms, triangular waveforms, sawtooth waveforms, sinusoidal waveforms or other suitable waveforms.

A second tubular may be in the form of a second casing or liner which is inserted through the interior of the casing suspended from the surface. The upper end of the second tubular may have an engagement region located along its exterior surface and positioned for engagement with the internal casing receptacle. The exterior surface of the engagement region may similarly be provided with a texture, e.g. a knurled texture, a waveform texture, or another suitable texture. It should be noted the waveform texture may again be in the form of a variety of waveforms, such as square waveforms, triangular waveforms, sawtooth waveforms, sinusoidal waveforms or other suitable waveforms.

In this embodiment, the engagement region of the second tubular is at least partially aligned with the interior receptacle of the casing/first tubular. A molten metal material is located in the space between the interior surface of the internal receptacle and the exterior surface of the engagement region. The molten metal material may be introduced into the space between the internal receptacle and the engagement region or it may be positioned at one or both of the internal receptacle and the engagement region during deployment. In some applications, the metal material is converted to a molten state while at the downhole location. Regardless, the molten metal material is subsequently solidified to create a metal-to-metal seal between the respective tubulars, e.g. the casing and the liner.

Depending on the application, some embodiments utilize a metal alloy material which expands as the material cools and/or solidifies. In this manner, the second tubular, e.g. a casing/liner, may be securely attached to the first tubular, e.g. a prior casing/liner. The metal material used to form the molten metal material for joining the tubulars may comprise a suitable alloy. Examples of such alloys include eutectic bismuth-based alloys or eutectic gallium-based alloys. By way of example, various eutectic alloys are available containing mixtures of bismuth, lead, tin, cadmium, and/or indium which may be mixed according to the parameters of a given environment and application. Similarly, eutectic alloys are available containing mixtures of gallium, indium, and/or tin which also may be mixed to suit the given environment and application. In some embodiments, the metal material is applied to the internal receptacle and/or the engagement region prior to their introduction into the wellbore. The metal material may then be melted in situ during, for example, alignment of the internal receptacle and engagement region or after the internal receptacle and engagement region are aligned with one another. Solidification of the molten metal material subsequently creates the metal-to-metal seal between the tubulars. In various well applications, the metal material is selected to enable support of the second tubular, e.g. liner, by the previously deployed first tubular, e.g. casing.

Referring generally to FIG. 1, an example of a system 20 for coupling a first tubular 22 and a second tubular 24 is illustrated. In this embodiment, the first tubular 22 and the second tubular 24 are connected via a coupling mechanism 26, such as a phase transition coupling mechanism. For example, the coupling mechanism 26 may comprise a metal material 28, e.g. a metal alloy, which transitions between a molten metal phase and a solid phase to couple the second tubular 24 to the first tubular 22.

In the embodiment illustrated, system 20 is in the form of a well system which may be deployed downhole in a wellbore 30 to enable joining of the second tubular 24 to the first tubular 22 at a desired downhole location 32. In some applications, the first tubular 22 comprises a casing and the second tubular 24 comprises another section of casing or liner extending farther downhole from and suspended from the first tubular 22. Although two tubulars 22, 24 are illustrated, system 20 may comprise greater numbers of tubulars coupled sequentially by a plurality of coupling mechanisms 26. Additionally, coupling mechanism 26 may be used for joining other types of tubular elements.

Referring again to FIG. 1, the first tubular 22 has an internal receptacle 34, e.g. a casing receptacle, formed by an internal surface 36 of the first tubular 22, e.g. casing. The second tubular 24 has an engagement region 38, e.g. liner engagement region, formed by an external surface 40 of the second tubular 24. The internal surface 36 may comprise an internal textured surface 42 and the external surface 40 may comprise an external textured surface 44. During coupling, the second tubular 24 is moved through an interior 46 of first tubular 22 until the engagement region 38 is at least partially aligned with receptacle 34. The textured surfaces 42, 44 help secure metal material 28 in a strong, supporting engagement with the first tubular 22 and the second tubular 24 when the metal material 28 is transformed from the molten metal state to the solidified state, as illustrated in FIG. 2.

In a specific embodiment, the first tubular 22 is a tubular element having an annular body portion 47 with a first end 48, a second end 50, interior 46, and an exterior 52. The internal receptacle 34 is disposed along the interior of the first end 48 of the annular body portion 47 and comprises textured surface 42. Similarly, the second tubular 24 is a tubular element having an annular body portion 54 with a first end 56, a second end 58, an interior 60, and an exterior 62. In this embodiment, the engagement region 38 is disposed along the exterior 62 of the second end 58 of the annular body portion 54 and comprises textured surface 44. In some embodiments, the second tubular element 24 may comprise a second receptacle 63 with a textured surface. The second receptacle 63 may be disposed at end 56, e.g. the lower end, for supporting an additional tubular element.

The second tubular 24 may be inserted through the first tubular 22 until the engagement region 38 is aligned with the internal receptacle 34. The molten metal material 28 is then solidified between the receptacle 34 of the first tubular 22 and the engagement region 38 of the second tubular 24 so as to form a metal-to-metal seal. The metal material 28 may be located on at least one of the textured surfaces 42, 44 and may be turned to a molten state prior to, during, or after movement of the second tubular 24 down through first tubular 22. In some applications, a tool may be delivered downhole and used to transform the metal material 28 into a molten state in situ prior to solidifying the metal material 28 so as to form the metal-to-metal seal.

Figure 2:
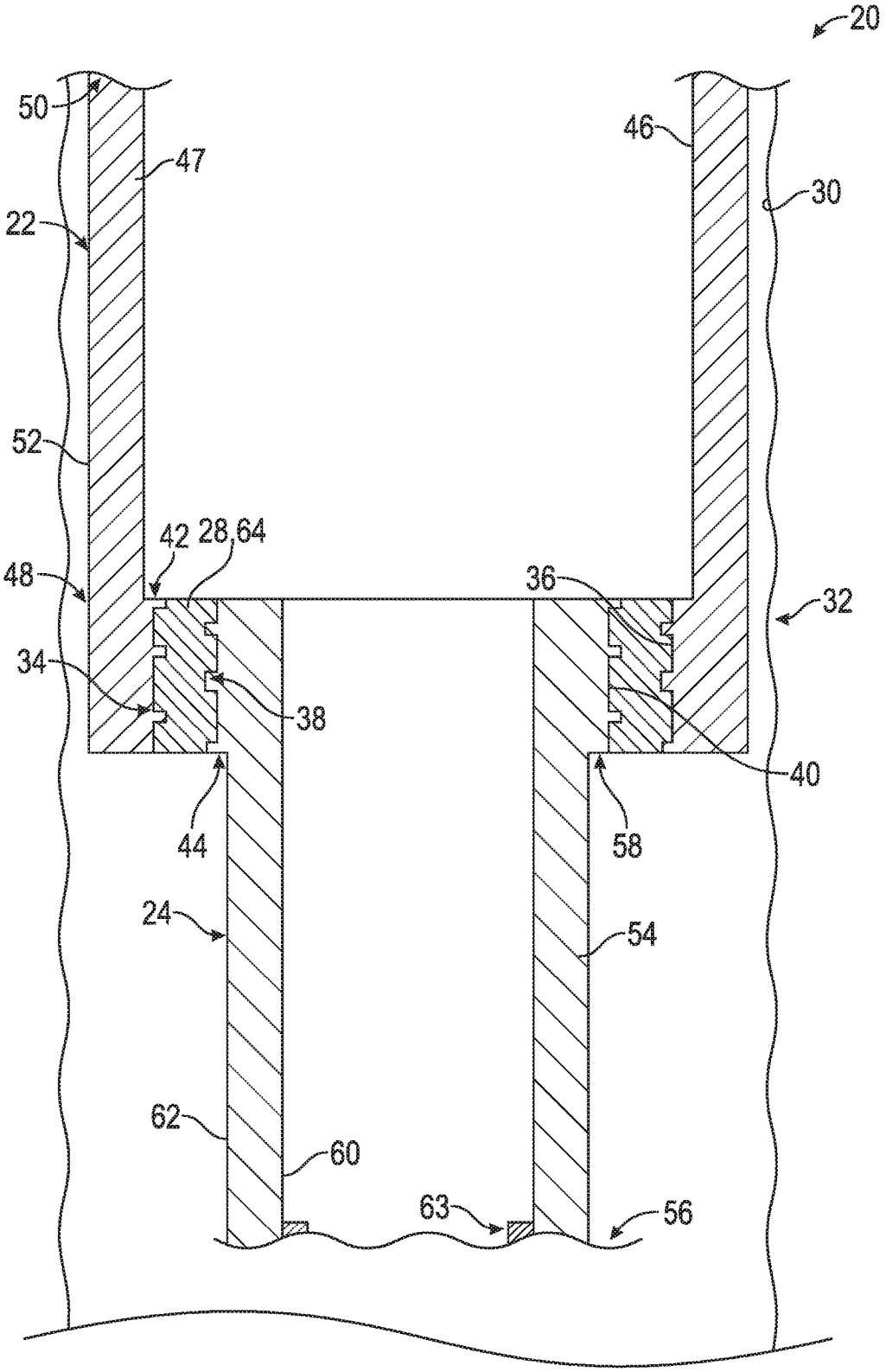
FIG. 2 is a schematic illustration similar to that of FIG. 1 after the second tubing has been joined to the first tubing via a molten metal material connection technique, according to an embodiment of the disclosure.

Referring generally to FIG. 2, system 20 is illustrated with a metal-to-metal seal 64 formed between first tubular 22 and second tubular 24. In a well application, the metal-to-metal seal 64 may be formed between tubular/casing 22 and tubular/liner 24. The metal material 28 may be melted during the same trip the second tubular/liner 24 is inserted into the wellbore 30 until engagement region 38 is aligned with internal receptacle 34. Furthermore, the metal material 28 may be melted by a heating/melting tool deployed downhole via wireline, tubing, or other suitable conveyance during a subsequent trip downhole. In well applications in which the casing and/or liner are cemented in place within wellbore 30, the metal material 28 may be melted on the same trip downhole used for the cementing operation. Accordingly, the metal material 28 may be melted at various times during the tubular coupling procedure.

When the melted, molten metal material 28 is solidified, the second tubular 24 is securely connected with the first tubular 22. In various well applications, e.g. tubing hanger applications, the metal-to-metal seal 64 should be strong enough to support the second tubular 24 from the first tubular 22 in the wellbore 30. The textured surfaces 42, 44 can be used to enhance the strength of the metal-to-metal seal 64 by providing greater surface area by improving support regions for the metal material 28. In some applications, the textured surface 42 has the same texture as textured surface 44 although the textured surfaces 42, 44 may be different to accommodate various parameters of the specific coupling operation.

As illustrated in FIGS. 3-7, the textured surfaces 42 and/or 44 may comprise a variety of circumferential patterns. FIGS. 3-7 illustrate different embodiments of a repeating pattern 66 which may be oriented circumferentially along internal surface 36 of first tubular 22 and/or along external surface 40 of second tubular 24. The textured surfaces 42 and/or 44 may be formed by knurling or by other suitable techniques, e.g. forging, casting, additive techniques.

In the embodiment of FIG. 3, the repeating pattern 66 has a square waveform profile 68. Similarly, FIG. 4 illustrates an embodiment of repeating pattern 66 having a sawtooth waveform profile 70; and FIG. 5 illustrates the sawtooth waveform profile 70 oriented in a different direction. In the embodiment illustrated in FIG. 6, the repeating pattern 66 of the textured surface 42 and/or 44 comprises a triangular waveform profile 72. FIG. 7 illustrates an embodiment of the textured surface 42 and/or 44 which has repeating pattern 66 arranged with a semicircular waveform profile 74.

Figure 8:
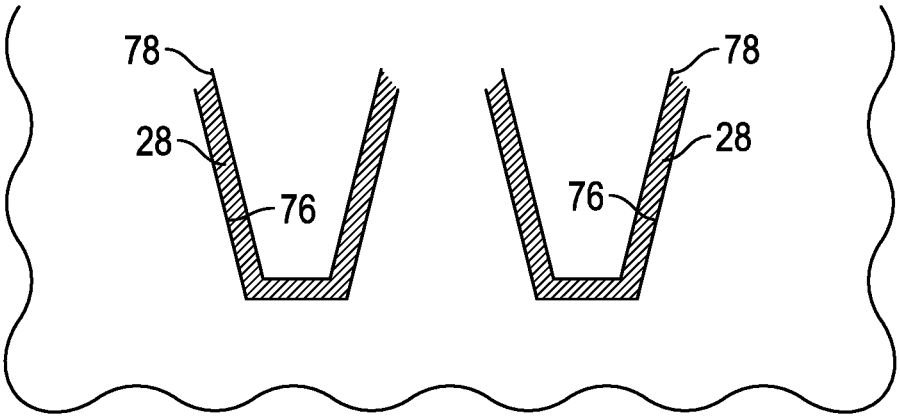
FIG. 8 is an illustration of another example of a textured surface profile which can be used to facilitate joining of the second tubing to the first tubing, according to an embodiment of the disclosure.
Figure 9:
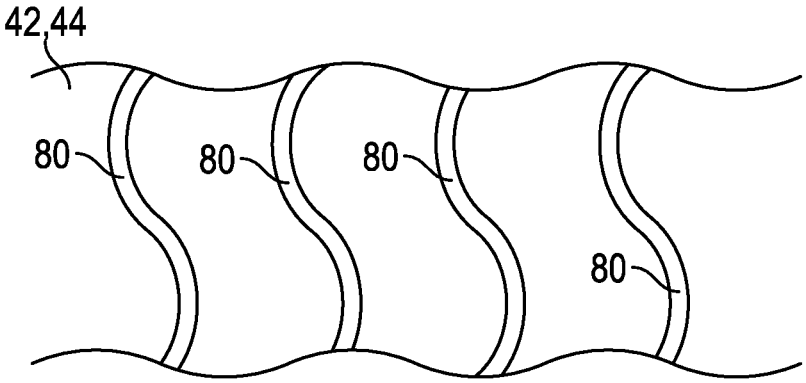
FIG. 9 is an illustration of another example of a textured surface profile which can be used to facilitate joining of the second tubing to the first tubing, according to an embodiment of the disclosure.

In some embodiments, the repeating pattern 66 may be arranged in a longitudinal direction as illustrated in the embodiments of FIGS. 8-9. For example, the repeating pattern 66 may comprise a plurality of receiving slots 76 formed along internal receptacle 34. The receiving slots 76 are sized to slidably receive corresponding portions 78 formed along engagement region 38. The receiving slots 76 and corresponding portion 78 are secured via metal material 28. In some embodiments, the repeating pattern 66 may be arranged in longitudinal S-shapes 80 (see FIG. 9) or other shapes along one or both of the textured surfaces 42, 44 to facilitate deployment and use of molten metal material 28. A wide array of circumferential profiles, longitudinal profiles, or other profiles may be used to provide a geometry into which the molten metal material may flow and then solidify to form the supportive, metal-to-metal seal 64.

Figure 10:
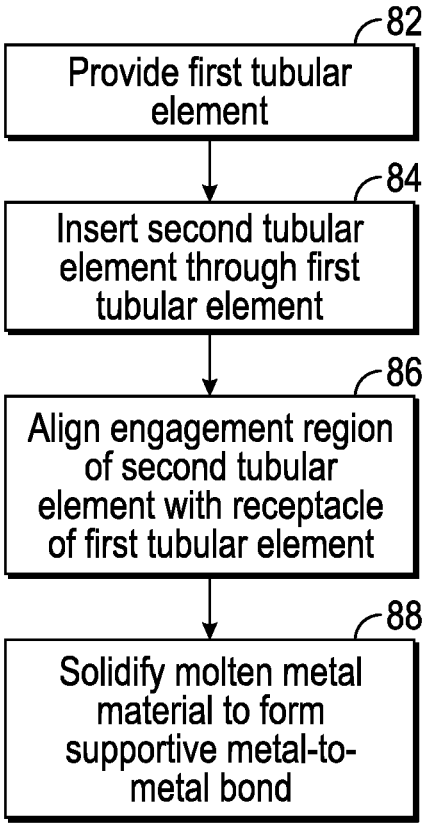
FIG. 10 is a flow diagram illustrating an example of a methodology for joining the second tubing to the first tubing, according to an embodiment of the disclosure.

Referring generally to FIG. 10, a flowchart is provided to illustrate an embodiment of the methodology for forming the metal-to-metal seal 64 between two tubular elements 22, 24. The first tubular element 22 is provided with internal receptacle 34 having textured surface 42, as represented by block 82. Additionally, the second tubular element 24 is provided with engagement region 38 having textured surface 44; and the second tubular element 24 is sized for insertion into the first tubular element 22, as represented by block 84. The second tubular element 24 is inserted until the engagement region 38 is at least partially aligned with internal receptacle 34, as represented by block 86.

A heated, metal material 28 (e.g. a molten metal alloy) is placed along the textured surfaces 42, 44; or the metal material 28 is heated in situ to form the molten metal material. The molten metal material is then solidified, e.g. allowed to cool until solidified, to form the metal-to-metal seal 64 between the first tubular element 22 and the second tubular element 24, as represented by block 88. In some applications the metal material 28 is selected so as to expand upon cooling and thus further secure the connection between first and second tubulars 22, 24. Examples of suitable metal materials 28 that may be used to form the metal-to-metal seal 64 include the bismuth-based alloys and gallium-based alloys discussed above. However, other alloys and metal materials (some of which expand upon cooling) may be employed to join the tubulars 22, 24 as described herein.

In some embodiments, the textured surface 42 of interior receptacle 34 may be symmetrical about a longitudinal axis of the first tubular 22. Similarly, the textured surface 44 of engagement region 38 disposed along second tubular 24 may be symmetrical about a longitudinal axis of the second tubular 24. (It should be noted the longitudinal axis of second tubular 24 often is coincident with the longitudinal axis of first tubular 22.) Symmetrical patterns may be used to provide improved cooperation between textured surfaces 42, 44 when used with metal material 28. When textured surface 42 has square waveform profile 68, for example, the square waveform profile possesses internal rings with square edges. In this embodiment, the textured surface 44 may similarly utilize square waveform profile 68 to provide corresponding internal rings with square edges. This arrangement of cooperating rings with square edges provides regions into which the molten metal material 28 may flow while also providing a rigid, secure connection once the metal material 28 is solidified.

Other embodiments, however, may utilize textured surfaces 42 and/or 44 which are not symmetrical about the longitudinal axes of the corresponding tubular elements 22, 24. In such embodiments, the internal receptacle 34 and/or engagement region 38 may be divided into zones with textured surfaces and zones with no texture. In some embodiments, the internal receptacle 34 and/or engagement region 38 may be divided into zones of differing textures, e.g. a waveform profile in one zone and a different profile in another zone. Similarly, the textured surfaces 42, 44 may have the same type of texture or different types of texture depending on the parameters of a given application.

The type and size of the texture on textured surfaces 42, 44 may be selected to enhance receipt of molten metal material 28 and subsequent solidification of the metal material 28. Additionally, the type and size of the texture can be used to adjust, e.g. enhance, the hanging and load capacity of the overall system 20. The material composition of metal material 28 also may be selected to provide the desired hanging and load capacity or other attributes for a given application and environment. In some embodiments, metal material 28 comprises a metal alloy containing bismuth. By way of further example, the metal material 28 may comprise a metal alloy containing antimony.

Depending on the parameters of a given application and/or environment, the structure of system 20 may be adjusted. For example, the tubular elements 22, 24 may comprise a variety of different types of tubular structures utilized in wellbore applications or other types of applications. Similarly, the structure and size of internal receptacle 34 and/or engagement region 38 may be adjusted according to the parameters of the operation in which system 20 is utilized. The type of metal material 28 as well as the type of textured surfaces 42, 44 also may be adjusted according to the application.

The tools and/or techniques for temporarily changing the state of metal material 28 to a molten state prior to solidification also may be selected according to specifics of the application. For example, metal material 28 may be applied to textured surfaces 42 and/or 44 at a surface location, delivered downhole, and then heated to a molten state by a heater delivered down through interior 46 via a conveyance. In other applications, the metal material 28 may be heated to a molten state prior to conveyance downhole or during conveyance downhole.

The heat for changing the metal material 28 to the molten state may be applied via a variety of heaters, including electric heaters, gas heaters, chemical heaters, or other suitable heating systems. The molten, metal material 28 may then be solidified by providing time for cooling and/or by removing heat via cooler, pumped fluids or via other heat removal techniques.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a well, comprising:

a first tubular element disposed in a wellbore, the first tubular element comprising a receptacle disposed on an interior of a first terminal end of the first tubular element and having an internal textured surface;

a second tubular element moved downhole within the first tubular element, the second tubular element comprising an engagement region disposed on an exterior of a second terminal end of the second tubular element and having an external textured surface; and a metal material disposed on the internal textured surface of the receptacle and the external textured surface of the engagement region as the second tubular element is moved downhole within the first tubular element, the metal material transitioning between a molten state to a solid state to secure the second tubular element to the first tubular element at a desired downhole location within the wellbore, wherein the metal material expands when solidified.

2. The system as recited in claim 1, wherein the second tubular element comprises a second receptacle disposed on an interior of the second tubular element, the second receptacle having a textured surface.

3. The system as recited in claim 1, wherein the internal textured surface and the external textured surface comprise knurled surfaces.

4. The system as recited in claim 1, wherein the internal textured surface and the external textured surface comprise waveform profiles.

5. The system as recited in claim 1, wherein the internal textured surface and the external textured surface comprise square waveform profiles.

6. The system as recited in claim 1, wherein the internal textured surface and the external textured surface comprise sawtooth waveform profiles.

7. The system as recited in claim 1, wherein the metal material expands as the metal material cools.

8. The system as recited in claim 1, wherein the internal textured surface of the first tubular element is different than the external textured surface of the second tubular element.

9. A method, comprising:

positioning a casing having a terminal end downhole into a wellbore;

deploying a liner having a terminal end down through an interior of the casing until the liner extends farther downhole than the casing, wherein a metal material is disposed on the terminal end of the casing and the terminal end of the liner as the liner is deployed down through the interior of the casing;

allowing the metal material to transition to a molten metal material at the terminal end of the casing and at the terminal end of the liner; and solidifying the molten metal material to support the liner as it hangs from the casing.

10. The method as recited in claim 9, further comprising providing the casing with an internal textured surface to receive the molten metal material.

11. The method as recited in claim 10, further comprising providing the liner with an external textured surface to receive the molten metal material.

12. The method as recited in claim 11, wherein providing the molten metal material comprises using molten metal material which expands when solidified.

13. The method as recited in claim 10, further comprising forming the internal textured surface with a different pattern than the external textured surface.

14. The method as recited in claim 10, further comprising forming the internal textured surface and the external textured surface as knurled surfaces.

15. The method as recited in claim 10, further comprising forming the internal textured surface and the external textured surface with waveform profiles.

16. The method as recited in claim 10, further comprising forming the internal textured surface and the external textured surface with square waveform profiles.

17. A method of forming a metal-to-metal seal between tubular elements comprising:

providing a first tubular element in a wellbore comprising:

an annular body portion having a first terminal end, a second terminal end, an interior and an exterior; and a receptacle disposed on the interior of the first terminal end of the annular body portion, wherein the receptacle comprises at least one textured surface having a metal material disposed thereon;

inserting a second tubular element into the first tubular element in the wellbore, the second tubular element comprising:

an annular body portion having a first terminal end, a second terminal end, an interior, and an exterior; and an engagement region disposed on the exterior of the second terminal end of the annular body portion, wherein the engagement region comprises at least one textured surface having a metal material disposed thereon;

aligning the receptacle of the first tubular element with the engagement region of the second tubular element;

allowing the metal material disposed at the at least one textured surface of the receptacle of the first tubular element and the metal material disposed at the at least one textured surface of the engagement region of the second tubular element to transition to a molten metal material; and solidifying the molten metal material between the receptacle of the first tubular element and the engagement region of the second tubular element so as to form a metal-to-metal seal.

18. The method as recited in claim 17, further comprising forming the molten metal material from a metal material which expands as the metal material cools.

19. The method as recited in claim 17, further comprising forming the molten metal material from a metal alloy.

* * * * *